United States Patent [19]

Hansen et al.

[11] 4,449,564

[45] May 22, 1984

[54] ADJUSTABLE TRACK FOR LOUVER DRAPES OR BLINDS

[76] Inventors: Don Hansen, 1703 E. Heritage Cir., Anaheim, Calif. 92804; Joseph C. Ranftl, 20192 Big Bend La., Huntington Beach, Calif. 92646

[21] Appl. No.: 297,048

[22] Filed: Aug. 27, 1981

[51] Int. Cl.[3] ..... E06B 9/26

[52] U.S. Cl. ..... 160/166 A; 160/168 R

[58] Field of Search ..... 160/168, 168 A, 166, 160/166 A, 250, 263, 223, 126, 172, 176; 211/105.3; 16/47, 106

[56] References Cited

U.S. PATENT DOCUMENTS

| | | | |
|---|---|---|---|
| 856,076 | 6/1907 | Ludwig | 160/126 |
| 1,042,491 | 10/1912 | Smith | 160/263 |
| 2,109,738 | 3/1938 | Spencer | 160/126 |
| 2,141,502 | 12/1938 | Ajovelo | 160/168 |
| 2,828,816 | 4/1958 | Nestor | 160/166 |
| 2,848,044 | 8/1958 | Ehrmeyer | 160/167 |
| 2,848,045 | 8/1958 | Bennett | 160/172 |
| 2,863,502 | 12/1958 | Cayton | 160/173 |
| 2,935,881 | 5/1960 | Cayton | 74/243 |
| 3,038,534 | 6/1962 | Cayton | 160/173 |
| 3,061,005 | 10/1962 | Bopp et al. | 160/176 |
| 3,130,775 | 4/1964 | Walker | 160/172 |
| 3,134,428 | 5/1964 | Kehrer et al. | 160/172 |
| 3,190,346 | 6/1965 | Arena et al. | 160/172 |
| 3,430,678 | 3/1969 | Steck et al. | 160/126 |
| 3,504,805 | 4/1970 | Doyle | 211/105.3 |
| 3,702,178 | 1/1963 | Wentzel | 160/133 |
| 3,844,330 | 10/1974 | Hyman | 160/166 |
| 4,049,038 | 9/1977 | Hyman et al. | 160/166 |
| 4,193,438 | 3/1980 | Pastore | 160/166 |

OTHER PUBLICATIONS

LouverDrape, Inc. publication, p. 32, shows vertical drapes.

LouverDrape, Inc. publication, p. 30, shows a chain drive for rotating the vertical drapes which are held to the overhead support by clips.

*Primary Examiner*—Peter M. Caun

*Assistant Examiner*—C. S. Lieberman

*Attorney, Agent, or Firm*—Gausewitz, Carr, Rothenberg & Edwards

[57] ABSTRACT

An adjustable track means for louver-type drapes or blinds having a telescoping supporting frame and telescoping driving means for drawing the drapes transversely and for rotating the individual louvers is described.

1 Claim, 15 Drawing Figures

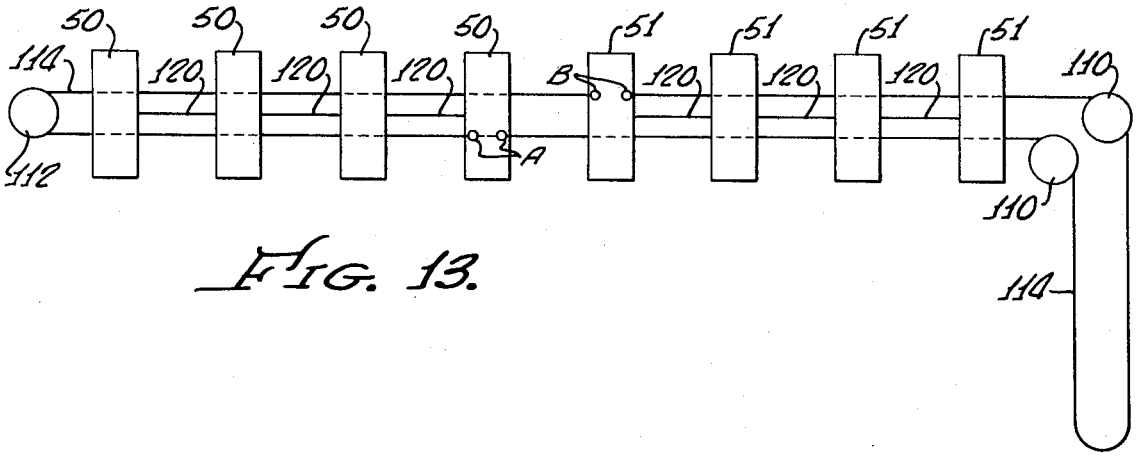
FIG. 13.
FIG. 14.
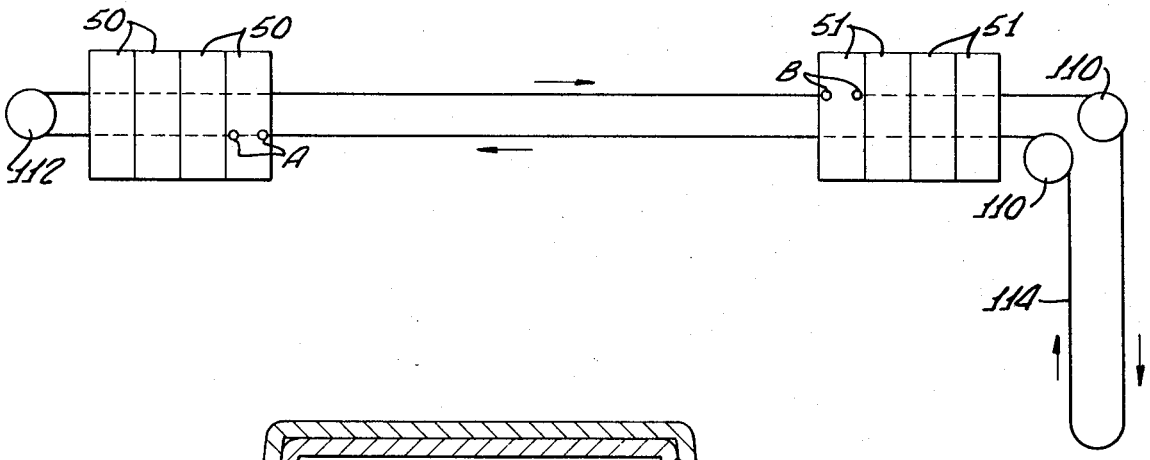
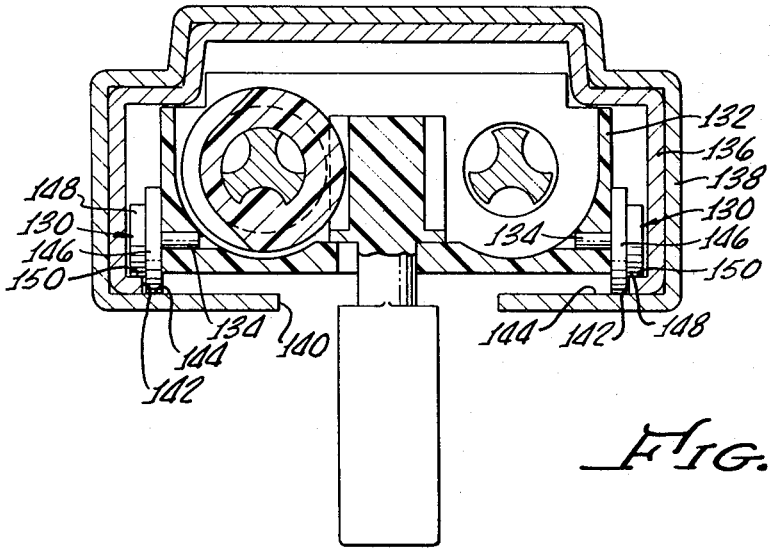
FIG. 15.

ADJUSTABLE TRACK FOR LOUVER DRAPES OR BLINDS

BACKGROUND OF THE INVENTION

This invention relates to louver-type drapes or blinds. More particularly, it relates to tracks for supporting louvers while permitting them to be rotated about their vertical axes and to be drawn transversely across a window opening along the track.

The use of louver-type drapes or blinds employing vertical louvers is well known. These types of window coverings have become available in recent years in a large variety of attractive fabrics and plastics of many available colors, designs, and degrees of opacity. They are used not only for conventional rectangular-shaped windows, but also for windows having unique designs. By rotating the vertical louvers to positions perpendicular to the windows, virtually unobstructed views can be obtained. Conversely, by rotating the louvers to positions parallel to the surface of the window, they can essentially totally block the passage of light through the window.

Numerous advances have been made in the modes of rotating louvers, supporting them in position adjacent the windows, and drawing them or traversing them across the windows. However, certain problems still plague the industry. Serious problems are encountered in using vertical louver-type drapes on windows having nonstandard widths. When windows that are narrower or wider than standard designs are encountered, it is necessary to custom-make the track at the top of the window that is used to support the louvers. Typically, the track consists of a metal bracket of some type running the full width of the window, housing and supporting individual trucks from which the louvers are suspended. Thus, it is necessary to cut off a portion of the track for narrower windows or to add extensions for wider windows. Unfortunately, since the ends of the brackets may house drive mechanisms for rotating or traversing the louvers, there is no convenient technique for shortening or lengthening the brackets without destroying their capacity to function properly. Moreover, since the drive mechanisms also typically extend across the width of the window, these devices also must be lengthened or shortened.

As a result of the difficulties in providing unusual sizes of supporting tracks and drive mechanisms for vertical louvers, it is found to be very expensive to use these types of drapes for windows of nonstandard widths, since complete custom designing is often necessary.

Another problem encountered with prior art types of tracks and drive mechanisms for louver-type drapes is that those intended for use on relatively wide windows are unwieldy and expensive to ship or store due to their length. One possible solution to this problem is to make several sections for each length of track, store or ship them while disassembled, and then have them assembled at the time of installation. Unfortunately, this solution is expensive and inconvenient from the standpoint of increased labor, parts construction, lost parts, and the likelihood of faulty assembly by untrained workers.

The foregoing and other problems that have long plagued the industry can be eliminated or greatly alleviated in accordance with the present invention.

SUMMARY OF THE INVENTION

This invention contemplates an adjustable support and positioning means for vertical louver drapes of the type in which louvers are suspended from multiple trucks. The trucks are mobile within a pair of axially aligned elongated frames adapted to telescope one within the other to extend or retract lengthwise to fit windows of different sizes.

A pair of elongated shafts are rotatably mounted longitudinally within the frames from opposite ends. The shafts are positioned to overlap or to telescope one within the other when the frame is extended or retracted so that the shafts also extend or retract. The shafts are equipped for engaging and driving gears in the various trucks to rotate the individual louvers between open and closed positions. Means are also provided to move or traverse the trucks longitudinally along the shafts to permit the louvers to be drawn to one side or to be spread to cover all or part of a window.

BRIEF DESCRIPTION OF THE DRAWINGS

FIG. 13 shows schematically the mechanism for traversing the louver drapes with the drapes shown positioned across the window;

FIG. 14 is similar to FIG. 13, except that the louvers are shown drawn to the sides of the support and positioning means; and FIG. 15 shows an alternative embodiment of the support and positioning means in cross-section.

DETAILED DESCRIPTION OF THE INVENTION

Figure 1:
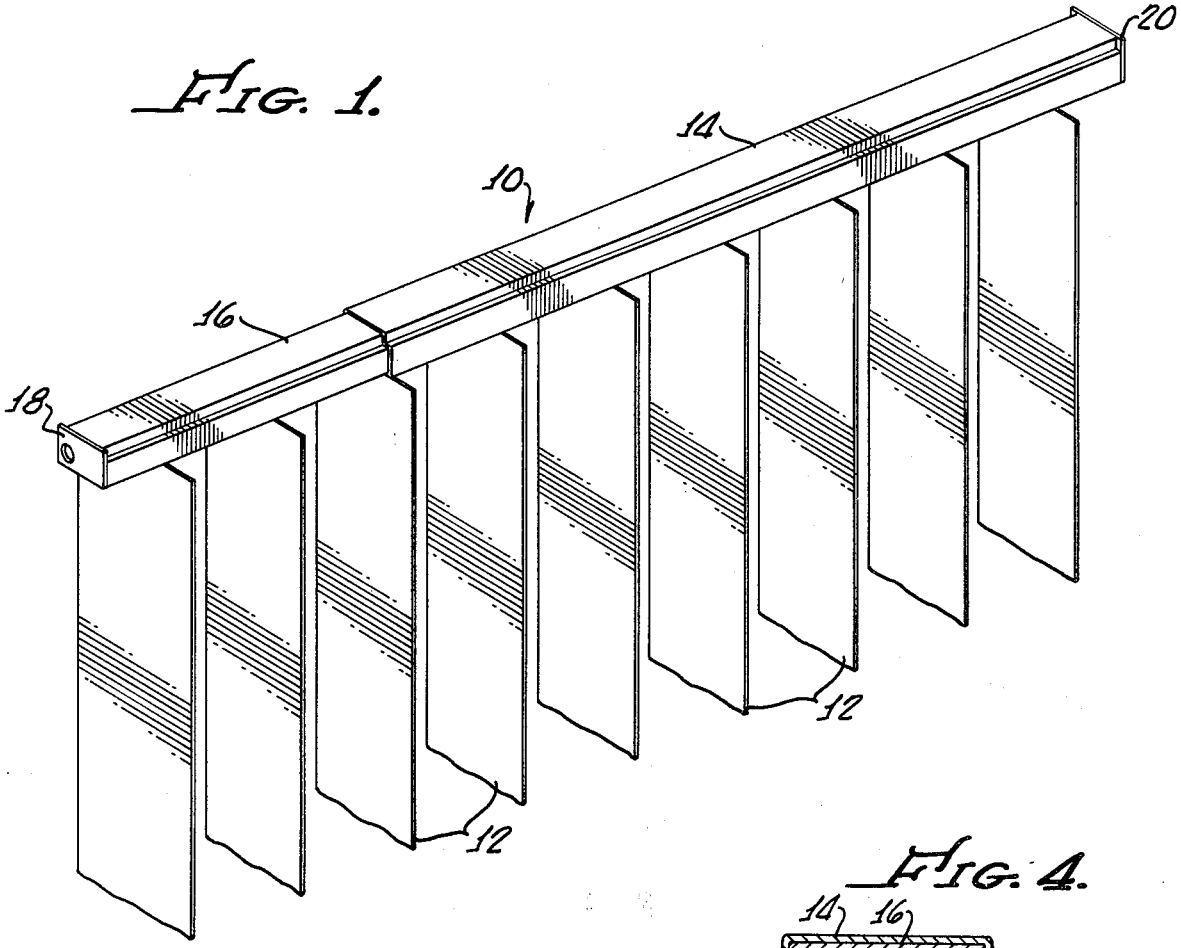
FIG. 1 shows in perspective louvers suspended from an adjustable support and positioning means in accordance with the invention.

Referring to FIG. 1, there is shown the adjustable support and positioning means 10 for supporting and positioning louvers 12. The means 10 includes an outer frame 14 engaged with, and partly enclosing, inner frame 16. Decorative end covers 18 and 20 fit in and close the outer and inner frames as illustrated.

Figures 2, 7, 8, 9:
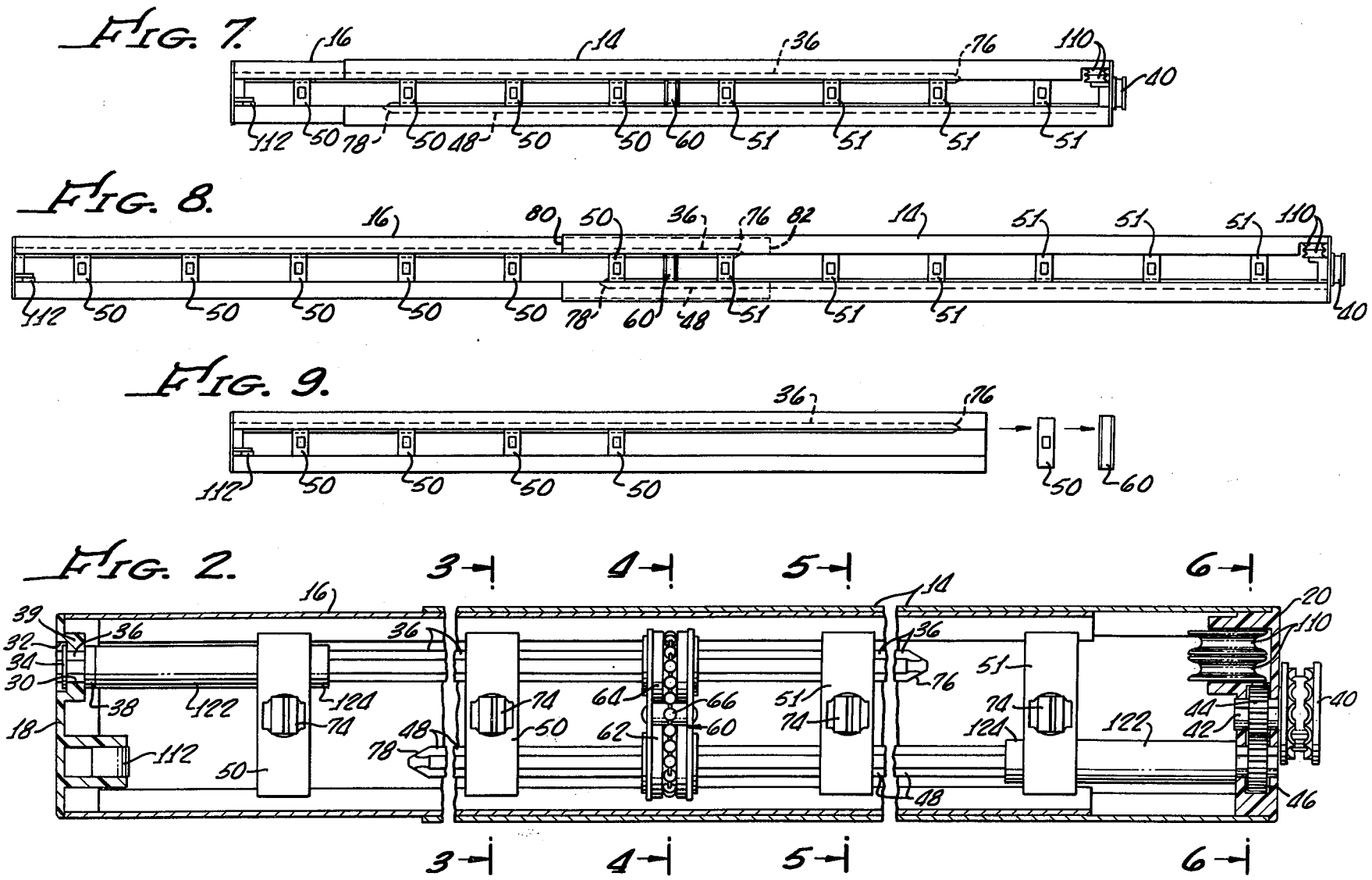
FIG. 2 shows a fragmentary bottom plan view of the support and positioning means.
FIG. 7 is a simplified bottom plan view of the support and positioning means retracted to a relatively short length.
FIG. 8 is a view similar to FIG. 7, except that the support and positioning means is extended in length.
FIG. 9 shows the left frame and drive shaft of FIG. 8 with the accompanying trucks, illustrating the method of disassembly.

FIG. 2 is a bottom plan view of the support and positioning means, and FIGS. 3 to 6 show details of certain of the components in cross-section. End closure 18 has an aperture 30 and a countersunk recess 32 which receives flange 34 of noncircular driven shaft 36. Shaft 36 fits within aperture 30 so that the inner surface of the aperture acts as a bearing means to provide for easy rotation of the shaft. A friction washer 38 acts with flange 34 to sandwich the wall 39 of the end closure 18 and secure shaft 36 longitudinally in position relative to the end closure.

End closure 20, shown at the right end of frame 14, is equipped with a sprocket 40 connected by an axle 42 to a primary gear 44 mounted inside the end closure, as shown, and engaged with a secondary gear 46. The secondary gear 46 is affixed to the end of positioning shaft 48, which extends inside the outer and inner frames parallel to shaft 36.

Figure 3:
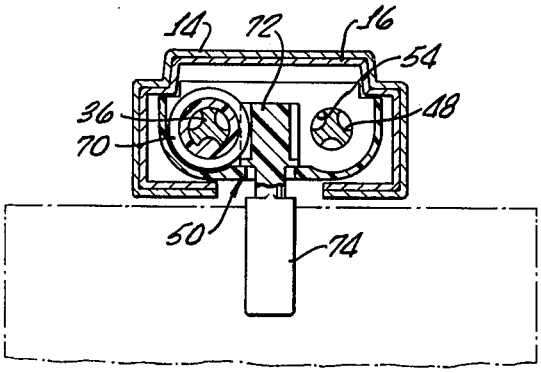
FIG. 3 is a cross-section taken along line 3—3 of FIG. 2.
Figure 5:
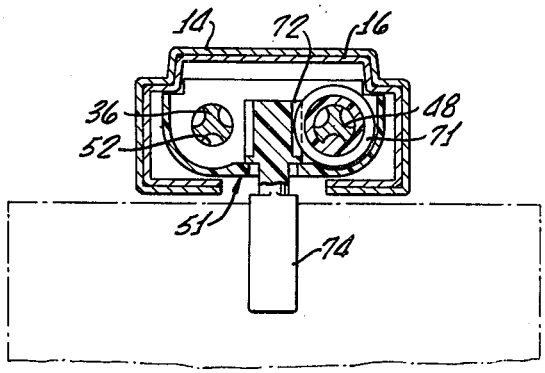
FIG. 5 is a cross-section taken along line 5—5 of FIG. 2.

A series of trucks 50 (left side of FIG. 2) and 51 (right side) dimensioned to fit, as shown in FIGS. 3 and 5, within outer frame 14 and inner frame 16 have axially parallel openings 52 and 54 for receiving and slidably engaging the parallel shafts.

Figure 4:
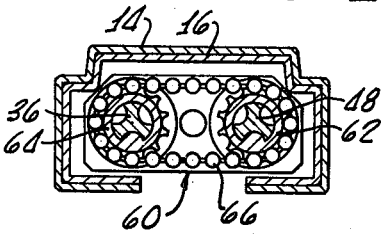
FIG. 4 is a cross-section taken along line 4—4 of FIG. 2.
Figure 6:
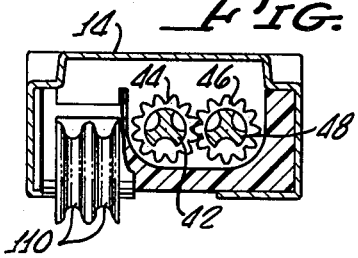
FIG. 6 is a cross-section taken along line 6—6 of FIG. 2.

To operate the support and positioning means for rotating the louvers, sprocket 40 is rotated, typically by a conventional draw chain or cord (not shown). The rotation is transmitted via primary gear 44 and secondary gear 46 to rotate positioning shaft 48, which in turn transmits rotation through transmission assembly 60 to driven shaft 36. As shown in FIG. 4, the transmission assembly 60 includes a pair of sprockets 62 and 64 connected by drive chain 66. The inner configuration of the sprockets 62 and 64 can be in any conventional form adapted to engage the surfaces of shafts 48 and 36, which are substantially uniform and noncircular in cross-section, so that rotational slippage between the sprockets and the shafts is eliminated. Thus, rotation of shaft 48 produces an exact corresponding rotation of shaft 36.

As shown in FIGS. 3 and 5, within each truck 50 a worm gear 70 is mounted to slidably engage shaft 36, and within each truck 51 a worm gear 71 is mounted to slidably engage shaft 48. The threads of the worms are selected, so that when the shafts are rotated together as shown, the various worms will engage gear means 72 which is connected to hanger hooks or clips 74. Clips 74 are rotatably mounted and extend downwardly from each truck. Thus, all of the hanger hooks on all the trucks are driven to rotate in the same direction simultaneously. The louvers 12 (shown in FIG. 1) are suspended from the various hanger hooks 74 in a conventional manner.

FIGS. 7 and 8 illustrate the adjustability of the support and positioning means for use in covering windows of different widths. For a narrow window the installer telescopes outer and inner frames 14 and 16 to a retracted position, as shown in FIG. 7, so that there is a substantial overlap of the frames and a corresponding substantial overlap between the tips 76 and 78 of shafts 36 and 48. Each of the shafts slides through the parallel openings 52 and 54 in the various trucks 50 and 51 and through the worm gears mounted within the trucks. Thus, the assembly can be telescoped to any convenient length and then positioned or fastened above a window using conventional techniques. For fitting the assembly to a wider window the inner and outer frames are telescoped to an extended position, as shown in FIG. 8. The shafts 36 and 48 are also simultaneously repositioned to the extended positions with much less overlap between their respective tips 76 and 78. As long as both shafts extend sufficiently to engage the centrally located transmission assembly 60, the assembly will still be operable to transmit rotation to all of the louvers when desired. By providing frames 14 and 16 slightly longer than the corresponding shafts 36 and 48, the ends 80 and 82 of the frames will overlap sufficiently, even at the most extended positions of the shafts, to ensure that the entire assembly is held together and has sufficient support in its midsection to hold the louvers.

When it is desired to change the number of louvers used (for example, when a substitution of different widths of louvers is made or when louvers have to be added or removed for use with windows of different sizes), the installer merely separates the two frames 14 and 16 completely so that trucks can be added or removed, as shown in FIG. 9. (FIG. 9 shows trucks being removed from inner frame 16, but the same technique applies to outer frame 14.) After the number of trucks has been revised, the two frames are simply telescoped back together and thus can be made ready for immediate installation.

Figure 10:
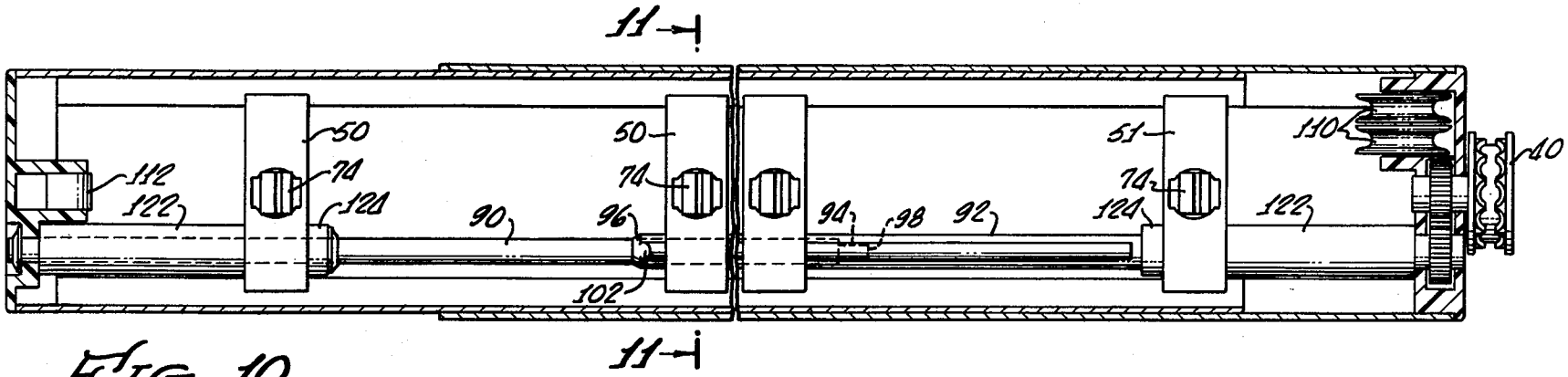
FIG. 10 shows a fragmentary bottom plan view of an alternative embodiment in which telescoping drive shafts are used.
Figure 11:
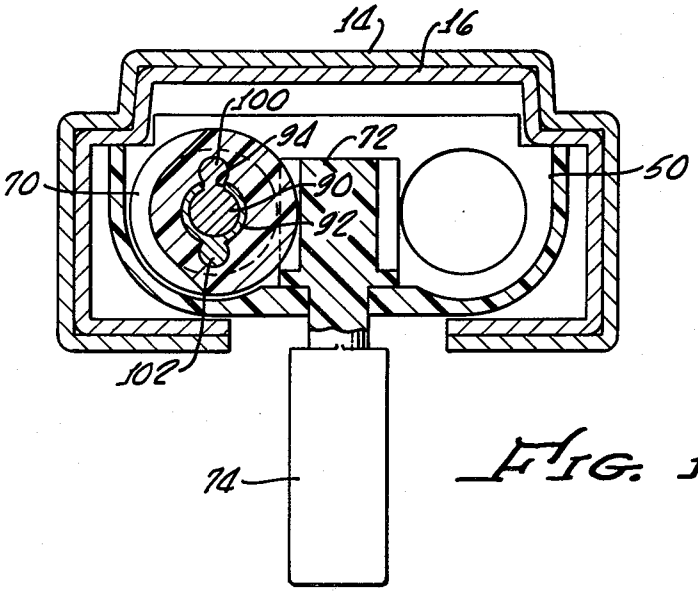
FIG. 11 is a cross-section taken along line 11—11 of FIG. 10.

FIGS. 10 and 11 show a preferred alternative embodiment of the invention in which the two shafts for positioning the various trucks 50 and 51 are axially aligned, and the outer shaft comprises a substantially tubular member 92 sized to receive inner shaft 90. This embodiment permits the same telescoping of the support and positioning means, as described above, with the additional advantage of eliminating the necessity for providing room for parallel shafts and a power transmission means, such as means 60 (FIG. 2). The outer tubular member 92 is provided with an opening or slot 94 running longitudinally along the tube from its tip 96 to a position 98 sufficient to permit a compatibly shaped bead 100, which runs longitudinally along inner shaft 90, to slidably engage slot 94, thus locking tube 92 and shaft 90 rotationally together while still permitting them to telescope longitudinally relative to each other.

FIG. 11 shows in enlarged cross-section the engagement of the bead 100 with slot 94. It should be noted that the bead 100 also serves the dual purpose of engaging worm gear 70 to rotationally lock the worm gear to the shaft while permitting the shaft to slide longitudinally through the gear when it is desired to telescope the assembly.

FIGS. 10 and 11 also show a longitudinal bead 102 running along the outer tube member 92 parallel to slot 94 but on the opposite side of the tube. Bead 102 also engages the worm gears in the various trucks. It is an important feature of this construction that the openings through the various trucks and worm gears can be sized sufficiently large for receiving the outer tubular member 92, and yet when the adjustable support and positioning means is extended for a wide window such that many of the trucks encase only the smaller inner shaft 90, there will still be a secure engagement between the inner shaft and the interior of the worm gear due to the interlocking of the bead with the gear.

Figure 12:
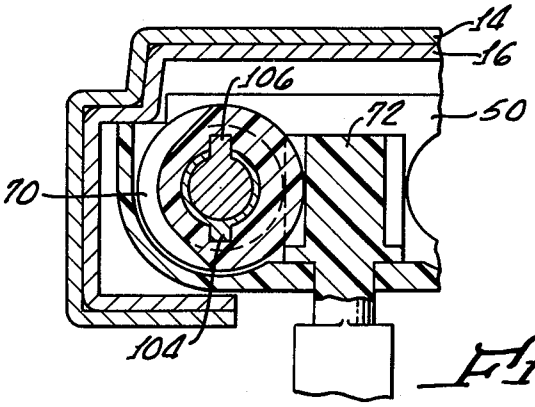
FIG. 12 shows in fragmentary cross-section a view similar to FIG. 11, except that an alternative structure of shafts is used.

FIG. 12 shows a simplified alternative embodiment in which the beads 100 and 102 are replaced by straight keys 104 and 106. The height of each key is sufficient to engage the corresponding recess in the worm gears to ensure that the gears are rotationally locked to the inner shaft or outer tubular member, irrespective of whether the shafts are telescoped relative to each other to the most retracted or most extended positions.

FIGS. 13 and 14 illustrate schematically the mechanisms used for positioning the louvers across a window. As shown in FIG. 13, each support and positioning means includes at least a pair of sprockets or pulleys 110 at one end of the assembly and an additional sprocket or pulley 112 at the other end. These members are also shown in FIGS. 2, 6, 7, 8, and 10. An appropriate draw cord 114 is shown in FIGS. 13 and 14 running through a continuous loop about the pulleys 110 and 112, as illustrated, and also passing through openings in the various trucks 50 and 51.

The draw cord 114 functions in the conventional manner. Thus, by drawing the cord in a clockwise direction, as shown in FIG. 14, the various trucks 50 and 51 can be traversed from the uniformly spread postion shown in FIG. 13 to the positions shown in FIG. 14. The draw cord passes loosely through each of the trucks, except the innermost truck 50 to which it is secured, as at points A, and to innermost truck 51 to which it is secured, as at points B. Thus, when the cord is drawn, the innermost trucks are pulled against the next adjacent trucks, and the trucks thus are pushed to opposite sides of the assembly. Conversely, by pulling the cord in the counterclockwise direction, the innermost trucks are pulled toward the center of the assembly. The various trucks are connected by means 120, which may be conventional fabric ribbons, or metallic connectors, or the like, to pull the various trucks to their spaced-apart position, as shown in FIG. 13. Since all of the connecting means 120 are of identical lengths, the trucks (and the various louvers suspended from them) will be precisely spaced across the assembly. To ensure proper positioning of the trucks, it is, of course, necessary to anchor the outermost trucks at both ends of the assembly. The means for achieving this are shown in FIGS. 2 and 10. Therein are shown spacer tubes 122 positioned about the shafts 36 and 48 (in FIG. 2) and shafts 90 and 92 (in FIG. 10). The tubes 122 precisely space the outermost trucks 50 and 51 from the end of the assembly and, thus, prevent the trucks from being moved to a position further outward along the shafts when the louvers are in the withdrawn or open position shown in FIG. 14. Conversely, friction washers 124 are positioned on the various shafts to engage the inner sides of the outermost trucks, as shown. The friction washers prevent the outer trucks from being drawn inwardly toward the center of the assembly when the drapes are drawn across the window, as shown in FIG. 13.

FIG. 15 shows a preferred embodiment of the support and positioning means in cross-section in which multidiameter wheels 130 are shown mounted on opposite sides of a truck 132 by means of axles 134, to permit the truck to be traversed through the inner frame 136 and outer frame 138 with minimal friction. In the embodiment shown, the inner edges 140 of outer frame 138 extend slightly beyond the inner edges 142 of the bottom of inner frame 136. This provides a shoulder 144 upon which the large diameter part 146 of the multidiameter wheel 130 can ride. The smaller diameter part 148 of the wheel 130 rides upon a corresponding shoulder 150 of inner frame 136. With this design, when the truck is traversed through the frames and leaves the inner frame, its elevation will not change (as occurs when a single diameter wheel is used and the wheel drops to the lower surface of the outer frame). Thus, when the truck is positioned within an area where the inner and outer frames overlap, both small and large diameter portions of the wheel engage the corresponding shoulders of the frames simultaneously. However, when the truck is positioned in an area where the two frames do not overlap, the wheel will engage the shoulder of the frame with the appropriate portion of the wheel that is aligned with that frame. Thus, the louvers suspended from the various trucks will maintain a precisely constant elevation while being traversed through all points across the frames.

Many other uses and variations of the invention will be apparent to those skilled in the art, and while specific embodiments of this invention have been described, these are intended for illustrative purposes only. It is intended that the scope of the invention be limited only by the attached claims.

What is claimed is:

1. Adjustable support and positioning means for vertical louver drapes of the type in which louvers are suspended from multiple trucks, comprising:

multiple trucks for suspending said louvers, a pair of axially aligned elongated frame means adapted for nesting one within the other and telescoping between an extended position and a retracted position, and a pair of elongated shafts each having substantially uniform noncircular cross sections and being mounted within said frame means and adapted to support and permit sliding movement of said trucks along said shafts, said shafts being capable of sliding in relation to each other between extended and retracted positions corresponding to the extended and retracted position of said frame means, each of said multiple trucks having a driving gear, a driven gear operatively connected to said driving gear, a housing for said gears, said housing being longitudinally slidably mounted within said elongated frame means relative to at least one of said shafts, such that said driving gear remains slidably engaged with said noncircular shaft when said housing and gear are moved therealong and when said frame and shafts are in any position from fully extended to fully retracted, and a supporting means for suspending a louver therefrom, said supporting means being rotatably mounted within said housing and operatively connected with said driven gear, whereby when said shafts are rotated about their longitudinal axes, said driving gear is rotated therewith and rotates said driven gear and said supporting means, said shafts being axially aligned and one of said pair of shafts being tubular and having an inside diameter sufficient to permit the other of said pair to telescope therein between said extended and retracted positions, the outer shaft of said pair of shafts including engaging means affixed along its outer surface for slidably engaging said driving gears of said trucks and having a slot through the wall of said outer shaft parallel to the axis thereof, the inner shaft of said pair of shafts including engaging means affixed along its outer surface and sized to extend outwardly through said slot through the wall of said outer shaft for slidably engaging said driving gears.

* * * * *